United States Patent [19]

Regev

[11] Patent Number: 4,958,988

[45] Date of Patent: Sep. 25, 1990

[54] MOTOR DRIVEN PUMP FOR PUMPING VISCOUS SOLUTIONS

[75] Inventor: Mordechai Regev, Nes Ziona, Israel

[73] Assignee: Ormat Turbines, Ltd., Yavne, Israel

[21] Appl. No.: 63,755

[22] Filed: Jun. 17, 1987

Related U.S. Application Data

[63] Continuation of Ser. No. 780,597, Sep. 26, 1985, abandoned.

[51] Int. Cl.[5] ..... F04B 17/00

[52] U.S. Cl. ..... 417/53; 417/366; 417/368

[58] Field of Search ..... 417/367, 366, 368, 371, 417/357, 53; 184/5, 6.16

[56] References Cited

U.S. PATENT DOCUMENTS

| | | | |
|---|---|---|---|
| 2,925,041 | 2/1960 | Sigmund | 417/357 |
| 3,371,613 | 3/1968 | Dahlgren et al. | 417/368 |
| 3,698,839 | 10/1972 | Distefano | 417/368 |
| 4,174,261 | 11/1979 | Pellegrino | 204/273 |
| 4,355,683 | 10/1982 | Griffiths | 165/60 |
| 4,465,437 | 8/1984 | Jensen et al. | 417/366 |
| 4,518,325 | 5/1985 | Kingston | 417/368 |
| 4,527,960 | 7/1985 | DeSisto | 417/423 A |

FOREIGN PATENT DOCUMENTS

| | | | |
|---|---|---|---|
| 551716 | 11/1956 | Italy | 417/357 |
| 148997 | 11/1980 | Japan | 417/368 |

*Primary Examiner*—Donald E. Stout

*Attorney, Agent, or Firm*—Sandler, Greenblum & Bernstein

[57] ABSTRACT

A motor driven pump for pumping a viscous solution of a solute in a solvent comprises an impeller for pumping the solution into an outlet chamber. A shaft is rigidly connected to the impeller and is rotatably mounted in hydrodynamic slide bearings for driving the impeller. A rotor is rigidly mounted on the shaft for rotation therewith in response to actuation of a stator that is operatively associated with the rotor for causing rotation of the shaft. A lubrication system is provided for delivering pressurized solvent to the bearings such that solvent leaking from the bearings flows into the outlet chamber.

17 Claims, 2 Drawing Sheets

MOTOR DRIVEN PUMP FOR PUMPING VISCOUS SOLUTIONS

This application is a continuation of application Ser. No. 780,597, filed Sept. 26, 1985, now abandoned.

TECHNICAL FIELD

This invention relates to a motor driven pump for pumping viscous solutions, and more particularly to a pump of the type described for pumping concentrated brine solutions.

BACKGROUND OF THE INVENTION

Direct contact air-brine heat exchangers are sometimes used to condition the air in an enclosure by extracting water vapor from the air. An example of such a heat exchanger is in U.S. Pat. No. 4,355,683 wherein concentrated brine is sprayed into a tower with which air from an enclosure is exchanged. The vapor pressure at the air/brine interface of the brine droplets or brine film in the tower is less than the vapor pressure of water vapor in the air at the temperature and pressure of the enclosure air; and as a result, the brine is hygroscopic causing moisture in the air to condense on the brine. Direct contact heat exchangers utilizing this principle are advantageous in greenhouses, for example, as a way to control humidity within the greenhouse during the day when evaportranspiration of plants produce water vapor that would, in the absence of some means of control, produce a humidity approaching 100%, a condition that is unhealthy for the plants.

In conditioning the air in an enclosure using a direct contact heat exchanger of the type described above, concentrated brine from a reservoir is exchanged with the heat exchanger. The brine returned to the reservoir is more dilute than the brine delivered to the reservoir by reason of the absorption of water vapor from the enclosure air contacted with the brine in the heat exchanger. To ensure proper operation, the dilute brine must be reconstituted; and it is conventional to exchange brine from the reservoir with a brine concentrator that evaporates water from the dilute brine thus concentrating it before returning it to the reservoir.

In each brine exchange process, a pump is usually required. Because of the corrosive nature of brine, and its relative viscosity compared to water, specially designed pumps are employed. Such pumps must be constructed of materials compatible with the corrosive brine and usually employ special seals to control leakage. Often, magnetic drives are employed such that the pump is entirely sealed in a housing, and a rotating magnetic field is coupled to the pump to drive the rotor. Not only are conventional pumps for pumping viscous corrosive solutions expensive, as compared with readily available water pumps of the same capacity, but they consume large amounts of power as compared with water pumps of the same capacity. For example, a water pump of a given capacity may cost about $100.00 and consume about 250 watts of power in operation. A comparable pump capable of handling a viscous corrosive brine may cost $500.00 and consume about 600 watts.

It is therefore an object of the present invention to provide a new and improved motor driven pump capable of pumping viscous solutions, such as brine, which is less expensive to manufacture and consumes less power in operation.

BRIEF DESCRIPTION OF THE INVENTION

According to the present invention, a motor driven pump for pumping a viscous solution of a solute in a solvent comprises an impeller for pumping said solution into an outlet chamber. A shaft rigidly connected to the impeller and rotatably mounted in hydrodynamic slide bearings is provided for driving the impeller. A rotor is rigidly mounted on the shaft for rotation therewith, and a stator is operatively associated with the rotor for rotating the shaft. The present invention provides lubrication means for delivering pressurized solvent to the bearings such that solvent leaking from the bearings flows into the outlet chamber. The flow of solvent through the bearings is adequate to support the shaft on a film of solvent that provides for lubrication of the bearings during operation of the pump. Only a relatively small amount of solvent compared with the mass flow of solution being pumped by the impeller is required. For example, when the solution is a concentrated brine, and the mass flow is approximately 5 cubic meters per hour for the purpose of removing about 200 liters per day of condensate from the air in a greenhouse, the fresh water flow to the bearings of the pump can be as small as two liters per day. Thus, the degree of dilution caused by the leakage of solvent from the bearings of the pump into the solution being pumped by the pump is negligible.

The present invention also consists in fashioning the impeller from a plastic material which is impervious to the corrosive brine, and plating the shaft with tungsten carbide. Alternatively, the shaft may be of ceramic material that will resist the corrosive effects of the brine.

BRIEF DESCRIPTION OF THE DRAWINGS

An embodiment of the present invention is disclosed in the accompanying drawings wherein.

DETAILED DESCRIPTION

Figure 1:
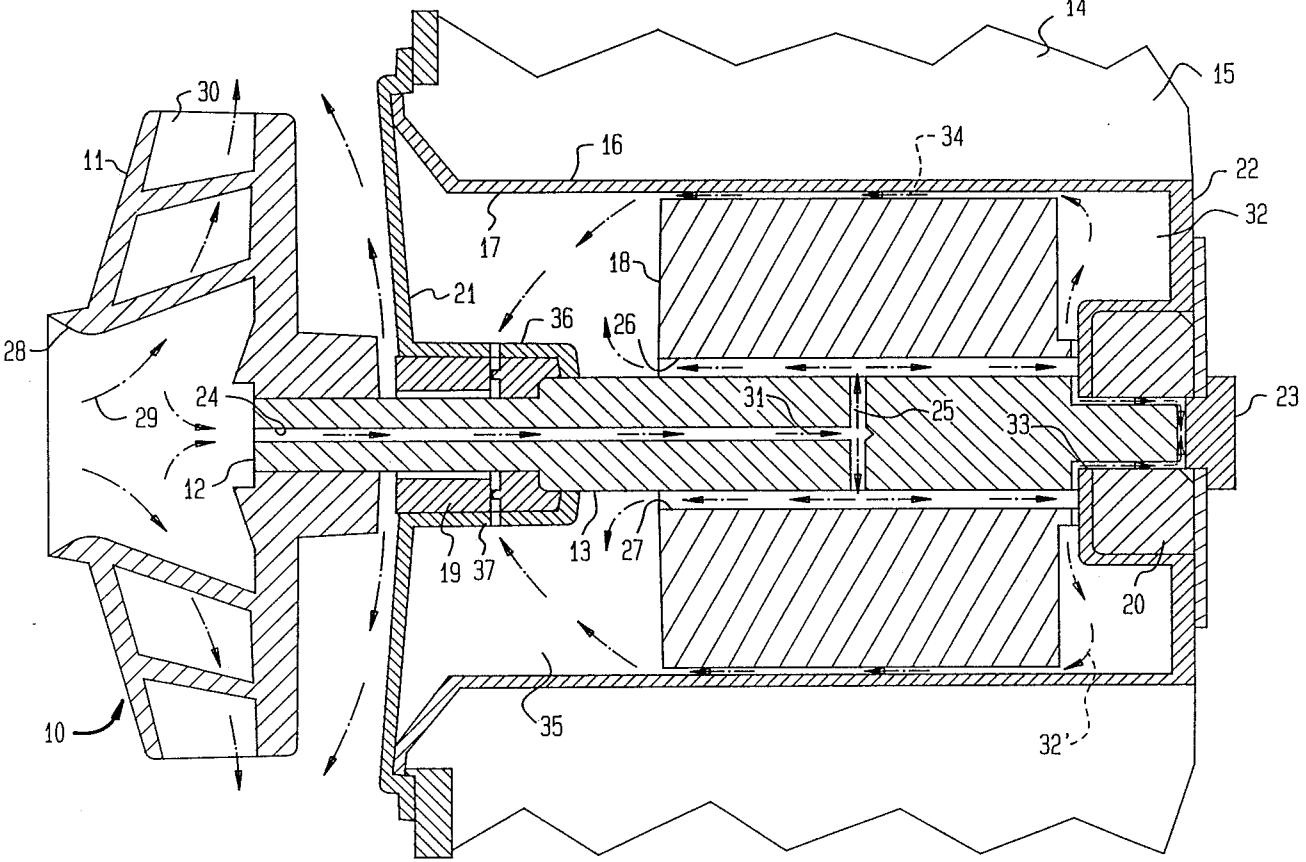
FIG. 1 (PRIOR ART)
FIG. 1 is a cross section of a typical conventional water pump which utilizes the water being pumped as a lubricant for the bearings of the pump.

Referring now to FIG. 1, reference numeral 10 designates a conventional water pump comprising centrifugal impeller 11 mounted on axial end 12 of motor shaft 13 of electric motor 14. The motor includes conventional stator windings 15 wound on cylindrical shell 16 defining cylindrical opening 17 containing rotor 18 keyed to shaft 13 for rotation therewith.

Shaft 13 is mounted in conventional hydrodynamic slide bearings 19, 20 which are fixed to shell 16 by connector plates 21, 22, respectively. The axial end of shaft 13 opposite end 12 is closed by plug 23 which snugly fits within a central aperture in bearing 20 for the purpose of providing a fluid seal.

Shaft 13 is provided with central axial aperture 24 opening at axial end 12 of the shaft but terminating short of the opposite axial end at transverse opening 25 about midway between the axial ends of rotor 18. The rotor itself is provided with a pair of axial apertures 26, 27 connecting with the transverse hole 25.

In operation, water is supplied to inlet 28 of impeller 11 as indicated by chain lines 29, and stator winding 14 is energized from a source of electrical power (not shown) for the purpose of causing rotor 18 to rotate within the central opening 17 thereby driving impeller 11. The design of impeller 11 is such that water in the central region of the impeller is drawn radially outwardly through openings 30 at the peripheral edge of the impeller; and this water is collected in a chamber (not shown) and is available to the user. In order to lubricate the bearings, some of the water entering inlet 28 flows through axial aperture 24 as indicated by the chain lines 31 toward transverse hole 25. The axially flowing water separates into two paths at hole 25 and flows radially outwardly into apertures 26 and 27 thereby flowing in one stream towards bearing 20 and in another stream towards bearing 19. The clearance between the axial endface of rotor 18 adjacent housing portion 22 permits the rearwardly flowing water in apertures 26 and 27 to flow into annular chamber 32' surrounding bearing 20 as indicated by the chain line 32. Some of the rearwardly flowing water also flows through the central opening 33 in housing 22 and around and into the clearance between bearing 20 and the axial end of the shaft contained with the bearing. This fluid serves to lubricate the bearing and forms a film of water which supports the rear end of the shaft in the bearing. The water is maintained within the clearance between the shaft and bearing 20 by reason of the pressure on the water flowing into aperture 24.

Water contained within annular chamber 32 flows forwardly around the periphery of rotor 18 as indicated by chain lines 34 and enters forward annular chamber 35 surrounding cup shaped portion 36 attached to the forward part of housing 21 and supporting bearing 19. This cup shaped housing is provided with apertures 37 which permits the water contained in chamber 35 to flow radially into the clearance between the forward end of shaft 13 and bearing 19 thereby providing support for the forward end of the shaft. Water leaks from the forward end of bearing 19 into the free space between impeller 11 and the housing 21 and joins the flow of water exiting at 30 from the impeller. In the manner described above the fluid being pumped by the impeller serves as lubrication for the bearings of the pump.

Figure 2:
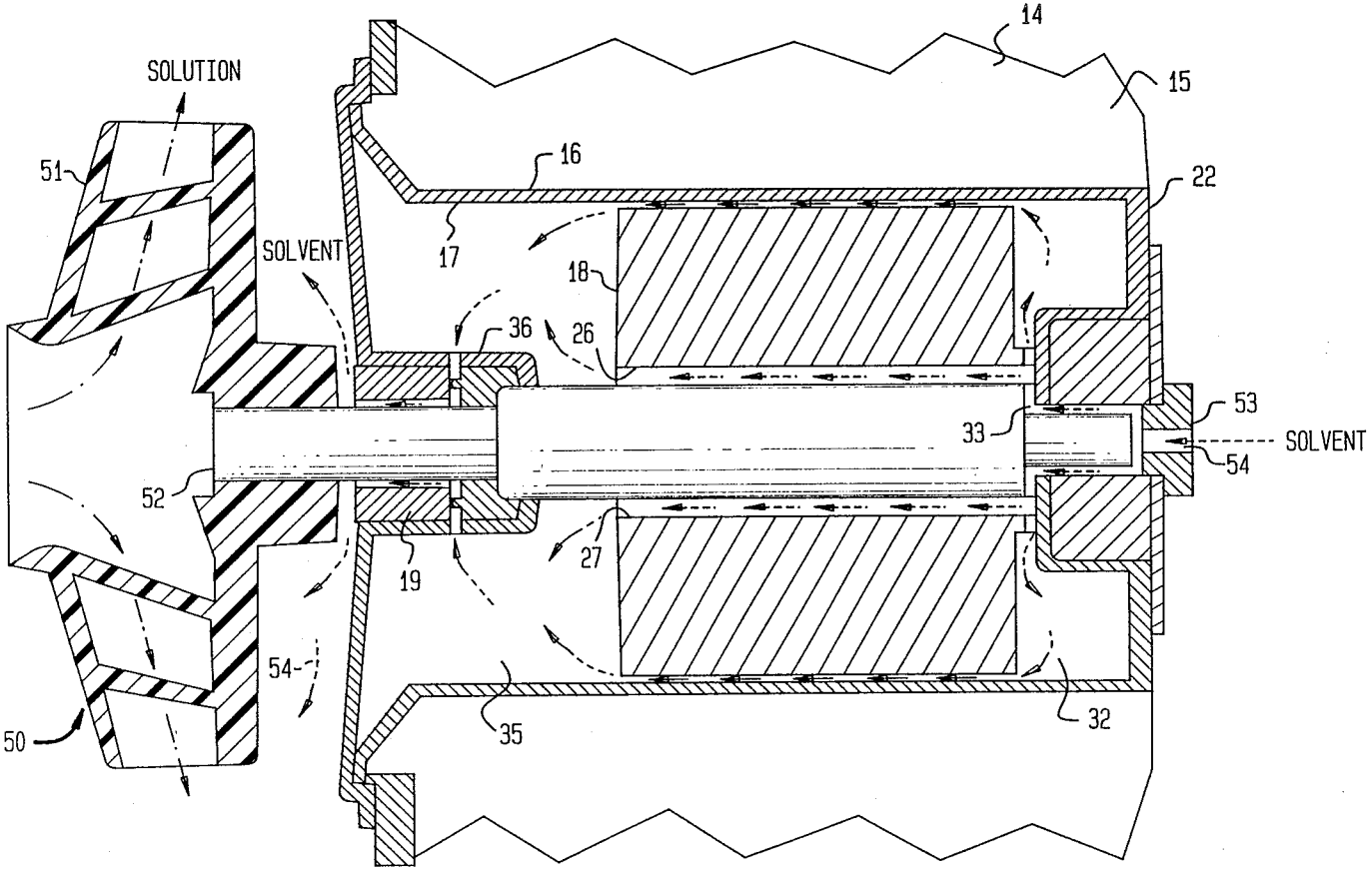
FIG. 2 is a cross sectional showing of the present invention.

An improved pump is shown in FIG. 2 by reference numeral 50. Pump 50 comprises centrifugal impeller 51 which is similar to impeller 11 except that impeller 51 is a plastic material that is not affected by corrosive brine when the solution being pumped is a solution of a salt (solute) dissolved in water (solvent). Alternatively, the impeller may be of stainless steel or other material suitable for use in brine. Other than the material of the impeller, the shaft on which the rotor is mounted, and the configuration of the plug that closes the bearing remote from the impeller, pump 50 is similar to pump 10; and, the same reference numeral is applied to corresponding, identical parts in the two pumps.

In pump 50, shaft 52 carrying impeller 51 at one axial end is solid and is not provided with an axial aperture like aperture 24 in shaft 12 of pump 10. In addition, plug 53, which engages with bearing 20 is not solid, but is provided with central axial bore 54 for receiving pressurized solvent. Such solvent flows through bore 54, as indicated by the broken lines in FIG. 2, and into the clearance between bearing 20 and the end of the shaft supported in the bearing providing the required support and lubrication for the bearing. Solvent leaks past the clearance formed by aperture 33 in shell 22 and flows into annular chamber 32 and into passages 26, 27 in rotor 18. The solvent is these passages flows forwardly toward the impeller into annular chamber 35. Radial apertures 37 in hub 36 supporting forward bearing 19 permit the solvent to flow into the clearance between this bearing and the forward portion of the shaft supported in this bearing thus providing support for the forward end of the shaft and the lubrication of bearing 19.

Solvent that leaks outwardly of bearing 19, as indicated by broken lines 54A flows into the chamber (not shown) that receives the solution being pumped by the impeller. Because the flow of solvent necessary to provide the bearings with lubrication is only a very small fraction of solution being pumped by the pump, the leakage of solvent into the solution in the outlet chamber of the pump has a negligible effect on the concentration of the solution. Moreover, the viscosity of the solvent is considerably less than the viscosity of the solution being pumped; and as a result the friction loss in the bearings when the configuration shown in FIG. 2 is used, rather than the configuration of FIG. 1 is used, will be considerably less. Thus, the present invention provides a pump for pumping viscous solutions that is no more expensive to build than a pump for pumping water, and which consumes considerably less power during operation.

To better resist the effects of corrosion of the solution on the shaft, the latter may be plated with tungsten carbide. Alternatively, a ceramic material may be used for the shaft.

The advantages and improved results achieved by the apparatus of the present invention are apparent from the foregoing description of the preferred embodiment of the invention. Various changes and modifications may be made without departing from the spirit and scope of the invention as defined in the appended claims.

I claim:

1. A motor driven pump for pumping a solution of a solute in a solvent comprising:

(a) an impeller for pumping said solution into an outlet chamber;

(b) a shaft rigidly connected to said impeller and rotatably mounted in hydrodynamic slide bearings for driving said impeller;

(c) a rotor rigidly mounted on said shaft for rotation therewith;

(d) a stator operably associated with said rotor for rotating said shaft; and (e) lubrication means for delivering only pressurized solvent to one of said bearings such that solvent flows through said one bearing and leaks into said outlet chamber thereby lubricating said one bearing and preventing solution in the outlet chamber from entering said one bearing.

2. A motor driven pump according to claim 1 wherein said rotor is located between said bearings and said lubrication means includes an axial flow path between said bearings that includes the periphery of said rotor whereby said solvent lubricates the rotor as well as the bearings.

3. A motor driven pump according to claim 2 wherein said impeller is located at one axial end of the shaft and one bearing is located at the other axial end of the shaft.

4. A motor driven pump according to claim 3 wherein said lubrication means includes means at said other axial end of the shaft for applying pressurized solvent between the shaft and the bearings.

5. A motor driven pump according to claim 4 wherein said means at said other axial end of the shaft includes a plug that seals said other axial end of the shaft, said plug having an axial aperture for connecting to a source of pressurized solvent.

6. A motor driven pump according to claim 5 wherein said solution is concentrated brine.

7. A motor driven pump according to claim 6 wherein said impeller is a plastic material.

8. A motor driven pump according to claim 7 wherein said shaft is plated with tungsten carbide.

9. A motor driven pump according to claim 7 wherein said shaft is of ceramic material.

10. A motor driven pump for pumping a solution of a solute in a solvent comprising:

(a) an impeller for pumping said solution into an outlet chamber;

(b) a shaft rigidly connected to said impeller and rotatably mounted in a pair of hydrodynamic slide bearings for driving said impeller;

(c) a rotor rigidly mounted on said shaft for rotation therewith;

(d) a stator operably associated with said rotor for rotating said shaft; and (e) means for delivering only pressurized solvent to the stator and rotor only the pressurized solvent passes through and lubricates one of said bearings.

11. A method for lubricating a bearing of a motor driven pump that pumps a solution of a solute in a solvent, said method comprising the step of applying only pressurized solvent to said bearing whereby the solvent leaks through said bearing, lubricates the same, and prevents said solution from entering said bearing.

12. The method of claim 11 including the step of directing solvent that leaks from said bearings to the output of the pump.

13. A motor driven pump according to claim 10 wherein said rotor is mounted between said pair of bearings.

14. A motor driven pump for pumping a soluton of a solute and a solvent, said pump comprising:

(a) an impeller for receiving said viscous solution and pumping the same into an outlet chamber;

(b) a shaft rigidly attached at one end to said impeller for driving the same, and rotatably mounted in a pair of spaced hydrodynamic slide bearings;

(c) a rotor mounted on said shaft between said pair of bearings, one of which is located between said rotor and said impeller, and the other of which is located on the end of the shaft opposite to said one end;

(d) a stator operatively associated with said rotor for rotating the same;

(e) means for applying to the other of said bearings, only pressurized solvent that lubricates said other of said bearings as said pressurized solvent leaks past said other of said bearings and flows toward said rotor;

(f) means for effecting transfer of the leaked solvent past said rotor toward said one bearing; and (g) means for effecting passage of pressurized solvent into said one bearing for lubricating the same as said pressurized solvent leaks past said one bearing and flows into the outlet chamber thereby preventing solution therein from flowing into said one bearing.

15. A motor driven pump according to claim 14 including a shell for mounting said bearings, said shell clearing said rotor for providing a path through which pressurized solvent flows toward said impeller.

16. A motor driven pump according to claim 15 wherein said rotor is provided with an axially extending aperture for effecting a path through which pressurized solvent flows toward said impeller.

17. A motor driven pump according to claim 14 wherein said impeller is a radial flow impeller.

* * * * *